United States Patent [19]

Haylett

[11] 4,306,015

[45] Dec. 15, 1981

[54] COLOR PHOTOGRAPHIC MATERIAL

[75] Inventor: Norman C. Haylett, Rittle, England

[73] Assignee: Ciba-Geigy AG, Basel, Switzerland

[21] Appl. No.: 172,505

[22] Filed: Jul. 28, 1980

Related U.S. Application Data

[63] Continuation-in-part of Ser. No. 5,648, Jan. 22, 1979, abandoned.

[30] Foreign Application Priority Data

Jan. 26, 1978 [GB] United Kingdom ..... 3109/78

[51] Int. Cl.[3] ..... G03C 7/00

[52] U.S. Cl. ..... 430/382; 430/443; 430/505; 430/544; 430/957

[58] Field of Search ..... 430/443, 448, 505, 382, 430/544

[56] References Cited

U.S. PATENT DOCUMENTS

| | | | |
|---|---|---|---|
| 3,227,551 | 1/1966 | Barr et al. | 430/226 |
| 3,632,345 | 1/1972 | Marx et al. | 430/543 |
| 3,928,041 | 12/1975 | Fujiwhara et al. | 430/505 |
| 3,932,185 | 1/1976 | Matsura | 430/505 |
| 4,015,988 | 4/1977 | Shiba et al. | 430/505 |

FOREIGN PATENT DOCUMENTS

| | | |
|---|---|---|
| 1224555 | 3/1971 | United Kingdom . |
| 1484273 | 9/1977 | United Kingdom . |

OTHER PUBLICATIONS

The Theory of the Photographic Process, 4th Ed., James, pp. 358–361, Macmillan, N.Y., 1977.

*Primary Examiner*—J. Travis Brown

*Attorney, Agent, or Firm*—Sprung, Felfe, Horn, Lynch & Kramer

[57] ABSTRACT

A process for the production of an improved photographic image is provided which comprises imagewise exposing photographic material which comprises on a support base at least one light-sensitive negative-working silver halide emulsion layer containing a color coupler (receptor layer) and in which after color processing a negative dye image only is formed, there being associated therewith at least one light-sensitive negative-working silver halide emulsion layer containing at least one DIR compound (development inhibitor releasing compound) and in which after processing no photographic image is present (donor layer), developing the photographic material in a color photographic developing solution to form a negative silver image in the layer which comprises the DIR compound and a coupled compound with the DIR compound in the areas in which the silver has been developed, so releasing the DI compound imagewise from the DIR compound and allowing the DI compound to diffuse imagewise into the layer containing the color coupler thereby to modify color development in this layer by forming a modified negative silver image and hence a modified negative dye image in the layer which comprises the color coupler, and further processing the material so that no photographic image is present in the layer which comprises the DIR compound and no silver image is present in the layer which comprises the color coupler and the dye image.

23 Claims, 1 Drawing Figure

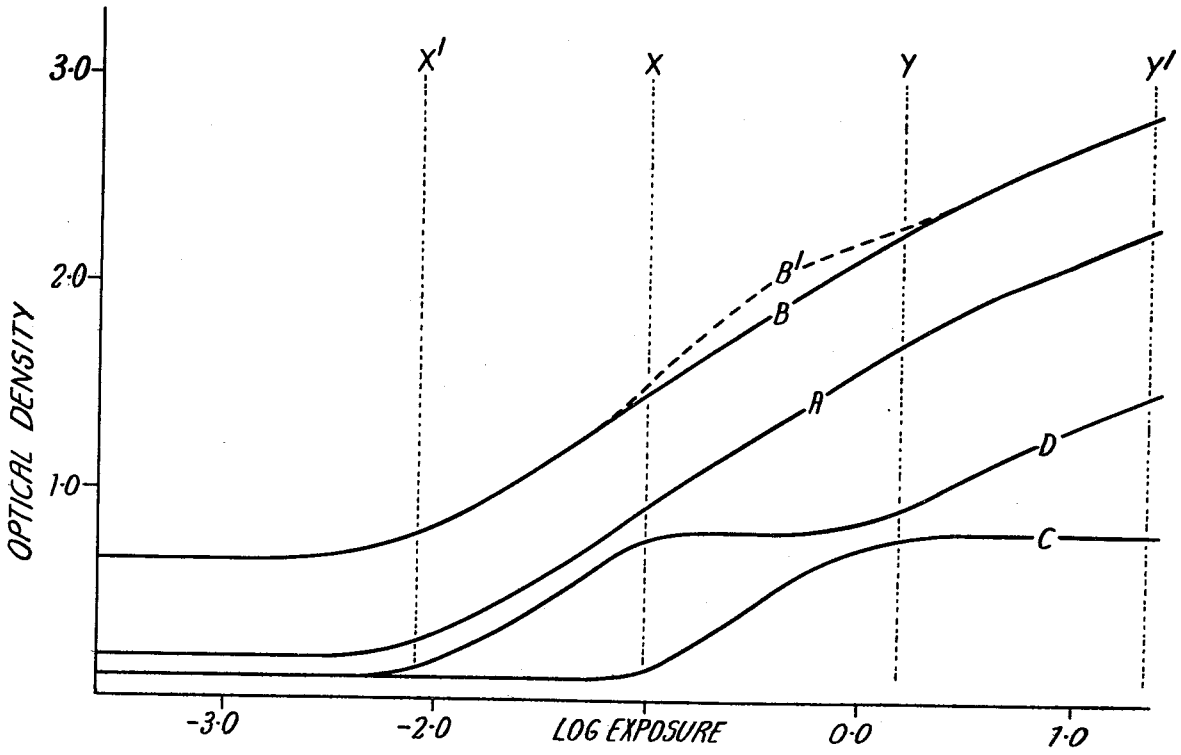
OPTICAL DENSITY
3·0
2·0
1·0
X'
X
Y
Y'
B'
B
A
D
C
-3·0
-2·0
0·0
1·0
LOG EXPOSURE

COLOR PHOTOGRAPHIC MATERIAL

This is continuation-in-part application of copending patent application Ser. No. 5648, filed on Jan. 22, 1979, now abandoned.

This invention relates to photographic material and in particular to colour photographic material.

In many colour photographic materials and in particular colour megative materials it is now common practice to incorporated in at least one layer of the photographic assembly a compound which reacts with the oxidation products of a colour developer to release a development inhibiting compound. This development inhibiting compound (hereinafter referred to as DI compound) may inhibit development in the layer in which it is released (intralayer effect) or it may diffuse into an adjacent layer and there inhibit development (inter-layer effect).

Compounds which release a DI compound are of three general types. The first is a DIR colour coupler which will couple with the oxidation products of a colour developer both to release a DI compound and to yield a coloured dye. The second type is a compound which will couple with the oxidation products of the colour developer to release a DI compound and to yield a colourless compound. The third type is a hydroquinone derivative which will react with the oxidation products of a colour developer in a way not yet fully understood to yield a colourless compound and release a DI compound.

All these three types of DIR compounds have been proposed to be used in various layers and in various ways in colour photographic material to effect both inter- and intra-layer effects. These effects can lead to improved sharpness of the final image and to increased colour saturation of the final image. DIR compounds can also be used to improve the granularity of the layer in which they are incorporated.

In all the colour photographic materials which have so far been proposed and which contain DIR compounds, the full potential of the use of such compounds has not been fully realised because of the constraints which are imposed by the current and proposed ways of using DIR compounds.

It is the object of the present invention to provide a process for the production of a photographic image using photographic material which employs certain DIR compounds and in which some of the constraints on their use in current and proposed materials are no longer present.

According to the present invention there is provided a process for the production of the photographic image which comprises imagewise exposing photographic material which comprises on a support base at least one light-sensitive negative working silver halide emulsion layer containing a colour coupler and in which after colour processing a negative dye image only is formed, there being associated therewith at least one light-sensitive negative-working silver halide emulsion containing at least one DIR compound and in which after processing no photographic image is present, developing the photographic material in a colour developing solution to form a negative silver image in the layer which comprises the DIR compound and a coupled compound with the DIR compound in the areas in which the silver has been developed so releasing the DI compound imagewise from the DIR compound and allowing the DI compound to diffuse imagewise into the layer containing the colour coupler thereby to modify colour development in this layer and to form a modified negative silver image and hence a modified negative dye image in the layer which comprises the colour coupler and further processing the material so that no photographic image is present in the layer which comprises the DIR compound and no silver image is present in the layer which comprises the colour coupler and the dye image.

By 'no photographic image being present in the layer' is meant that there is no visual reproduction of the exposure in the layer.

The treatment to remove the unwanted silver image from the silver halide layer which comprises the colour coupler, and the silver halide layer which comprises the DIR compound, will include a silver bleaching treatment followed by and/or coincident with a silver halide fixing treatment. Preferably the photographic material used in the process of the present invention contains a DIR compound which after reaction with the oxidation products of the colour developer releases a DI compound and forms a substantially colourless product. However it is possible to use in the process photographic material in which the DIR compound after coupling with the oxidation products of the colour developer yields a dye image which is not substantive to the layer in which it is formed and can be washed out or otherwise removed from this layer. Alternatively the DIR compound may form a dye which can be destroyed by chemical or physical means.

Thus according to another aspect of the present invention there is provided photographic material which comprises on a support base at least one light-sensitive negative-working silver halide emulsion layer containing a colour coupler and in which after processing a negative dye image is formed, there being associated therewith at least one negative-working light-sensitive silver halide emulsion layer in which after processing no photographic dye image is formed and which comprises at least one DIR compound which after reaction with the oxidation products of a colour developer releases a DI compound and forms a substantially colourless product.

By 'colour developing solution' is meant a developing solution which contains an alkaline solution of a developing agent (normally a paraphenylene diamine derivative) which is able to develop the latent silver image and form an oxidised reaction product which can couple with a colour coupler to form a negative image dye.

By 'DIR compound' is meant a compound which will react with the oxidation products of a colour developer and release a development inhibiting compound. Thus in the photographic material of use in the present invention there can be present any of the three types of DIR compounds hereinbefore listed, that is to say, a DIR coupler which couples with the oxidation products of a colour developer to yield a dye image and releases a DI compound, as long as the dye image so formed can be removed from the layer or destroyed in the layer, or counteracted by the presence of a coloured coupler which becomes colourless on coupling, a DIR compound which couples with the oxidation products of the colour developer to yield a substantially colourless reaction product and which releases a DI compound or a hydroquinone DIR compound which reacts in some way with the oxidation products of a colour developer to release a DI compound but which forms substantially no stain nor dye image.

By 'associated therewith' is meant that the layer which contains the DIR compound is either coated directly adjacent to the light-sensitive silver halide layer or is closely adjacent to said layer and separated therefrom only by a layer(s) which will not prevent the diffusion of a DI compound from the layer which contains the DIR compound into the associated layer containing the colour coupler.

By 'substantially colourless' is meant that the reaction product between the DIR compound and the oxidised colour developer is virtually colourless, that is to say it contributes at the most no more than 10% of the final density of the photographic material.

By 'substantially no image in the layer' is meant that the residual image if present is so faint that it contributes not more than 10%, but preferably much less, of the final density image of the photographic material.

In the process of the present invention when the photographic material is developed using a colour developer solution a DI compound is released imagewise from the layer which contains the DIR compound and is received in the associated layer in which the final negative dye image is formed.

The negative working silver halide light-sensitive layer which contains at least one DIR compound and in which no final photographic image is present is hereinafter called a donor layer. The layer associated therewith, i.e. the silver halide light-sensitive emulsion layer in which the final negative dye image is formed is hereinafter called an acceptor layer.

According to another aspect of the present invention there is provided a process for the production of an improved photographic image which comprises imagewise exposing photographic material which comprises on a support base at least one light-sensitive silver halide emulsion layer containing a colour coupler (receptor layer) and in which after processing a photographic dye image only is formed there, being associated therewith a least one light-sensitive silver halide emulsion layer containing at least one DIR compound (development inhibitor releasing compound) and in which after processing no photographic image is present (donor layer), developing the photographic material in a colour photographic developing solution to form a dye image in the layer containing the colour coupler and to release a DI compound imagewise from the DIR compound and further processing the material so that no photographic image is present in the layer which comprises the DIR compound and no silver image is present in the layer which contains the dye image.

The process of the present invention is of particular use in the preparation of colour photographic images. Also the photographic material of the present invention is of particular use as a colour negative material.

Modern colour negative materials consist in principle of three light-sensitive elements, sensitive to the blue, green and red parts of the visible spectrum and in which respectively yellow, magenta and cyan image dyes are produced. Because these image dyes are not colorimetrically pure in so far as they have significant absorption of light outside the required absorption (for example the cyan dye is also partly magenta—it absorbs green light) it is well-known in the art to add coloured colour couplers which can correct for the unwanted dye absorptions. For example a yellow-coloured magenta colour coupler (called 'mask') is often added to the magenta forming layer. This 'mask' has the same density as the unwanted absorption of the magenta dye to be formed in the layer. On colour development the yellow coloured magenta coupler produces imagewise a similar magenta dye to that produced by the magenta colour coupler in this layer while the yellow colour is destroyed imagewise. Thus the yellow density in the magenta forming layer is uniform. This use of masking couplers represents the first stage in improving colour reproduction.

Another improvement can be effected by the suppression of one developing layer by another. For example, by the addition of a DIR coupler to the green-sensitive layer, DI compound is released which reduces the (simultaneous) development of the red-sensitive layer. If the negative material is constructed so that it gives a true grey-scale to an uncoloured exposure, a red exposure will produce an enhanced cyan dye density and hence a more saturated red (in the print) because the green-sensitive layer (as it does not respond to a red exposure) no longer inhibits the development of the red-sensitive layer, Thus the addition of a DIR coupler to one layer of a colour negative material can improve the saturation of the colour to which the layer that receives the DI compound is sensitive.

In order to optimise the use of this effect it is evident that the layer in which the DI compound is generated (donor layer) should be relatively less affected by the DI compound compared with the layer in which the DI compound is received (acceptor layer). There is however a requirement in state-of-the-art colour negative materials for improvements in saturation to be achieved in both the green- and red-sensitive layers and thus it is necessary for each layer mutually to suppress the other. This requirement is however contrary to the other need for (as stated earlier) the donor layer to be relatively less affected by the DI compound than the acceptor layer as both layers must now function as both donor and acceptor layers.

In the state-of-the-art usage of DIR couplers, for example where a DIR coupler is used in the green-sensitive layer to suppress the density of the red-sensitive layer, this density can only be suppressed over the (whole) range of wavelengths to which the green-sensitive layer is sensitive, whereas from the viewpoint of colour reproduction it may be more desirable to suppress the red-sensitive layer either over only one part of the sensitivity of the green-sensitive layer or over a wider area of the spectrum than the green-sensitive layer. These restrictions apply equally to other colour negative materials where the DIR compound is incorporated in a layer which does not contain a light-sensitive silver halide emulsion but relies upon the diffusion of oxidised developer which is generated in an adjacent layer. However in the present invention the need for compromise between donor and acceptor properties of the same layer is obviated. This is done by providing at least one specialised donor layer which donates DI compounds but whose effect on the print (its printing density) is unaffected either by DI compounds formed in the layer or which migrate into the layer. This is achieved by using a DIR compound the reaction of which with oxidised colour developer results in (by whatever method) a substantially colourless product or which yields a dye which can be destroyed or removed from the donor layer or the effect of which can be counteracted by the presence of a coloured coupler which becomes colourless on coupling.

A further beneficial consequence of the interlayer suppression brought about by DIR compounds is that the released DI diffuses laterally as well as vertically, giving rise to a Horizontal Eberhard effect and its attendant improvement in sharpness. In the present invention this effect may be assisted by arranging for the colourless donor layer to be less sharp than the acceptor layer with which it is associated.

Thus in the photographic material of use in the present invention it is most important that the donor layer is a light-sensitive silver halide emulsion layer to ensure that oxidation products of colour developer are formed therein and are able to liberate the DI compound from the DIR compound imagewise. Further it is most important that no final dye image is present in the donor layer. Because the donor layer does not contribute to the final image of the photographic material the silver halide emulsion of this layer may have any desired speed, spectral sensitivity or D-log E curve appropriate to the effects which it is desired that the donor layer achieves. As the donor layer does not contribute to the final image, the silver halide emulsion on which it is based need have properties relevant only to its role in suppressing density in the acceptor layer; in conventional systems the quality of its own image has to be taken into account in the overall optimisation of the products and these two roles of the emulsion can be incompatible. Thus it may be desirable to suppress the development of the acceptor layer in a particular way over a limited exposure range. In the present invention a donor layer of limited exposure range appropriate only to the desired effect can be used and this would not require simultaneous modification of another image forming layer.

This may be explained by the accompanying drawings (The FIGURE) in which A represents the characteristic curve with a white light exposure of the red-sensitive layer of a tripack which contains silver halide and the cyan image forming coupler. B represents the characteristic curve with a white light exposure of the green-sensitive layer of the tripack which contains silver halide and the magenta image-forming coupler. However in order to enhance the saturation of light greens it may be desirable to obtain enhanced response from the green-sensitive layer to a green light exposure between the exposures X and Y as represented by the line B'.

If the DIR coupler were located conventionally in the red-sensitive layer which contains cyan image-forming coupler the DI compound would be released over its entire exposure range and would suppress the green layer response between X' and Y' instead of between X and Y. To limit the suppression effect to the exposure range XY requires that the DIR coupler be located in a third layer in which the silver halide emulsion has the exposure range XY rather than X'Y'. If the third layer contained silver halide and cyan image forming coupler and thus gave rise to a characteristic curve such as C, the sum cyan image characteristic curve required (i.e. A) would have to be obtained by the use of a fourth layer containing silver halide and cyan-image forming coupler. The characteristic curve of this fourth layer is represented by D. Such an unusual characteristic curve is difficult to achieve. However the third layer as described in this application cyan image characteristic curve C would not be obtained and the layer which gives rise to characteristic curve A would be unaffected.

It may also be desirable to obtain suppression of the acceptor layer at very low exposures in which case the silver halide emulsion in the donor layer would need to be very sensitive and would consequently contain very large silver halide crystals. In a conventional system in which a dye-image forming coupler is associated with such a donor layer the image dye produced would necessarily have a high granularity. In the material of use in this invention no such deterioration in image quality would result because no final dye image is present in this layer. Moreover it is known that the efficiency with which a development inhibiting compound is released from a layer may depend critically upon the concentration of silver halide within that layer. Thus in the material of use in this invention the concentration of silver halide in the donor layer need be optimised only with regard to its developer inhibitor releasing effect; however in the conventional system the photographic material must be designed to ensure that sufficient silver halide is present in a donor layer which is an image-forming layer to ensure that an even image structure is formed. These two requisites are often mutually incompatible.

The spectral sensitivity of the donor layer is also freed from constraints. In a conventional system the spectral sensitivity of an emulsion must be selected with regard to the colour of the image dye which is produced by the coupler associated with it. This invention allows the obtainment of wavelength-specific interimage effects, for example enhanced suppression at the limits of an acceptor layer's wavelength sensitivity range or over specific, limited, wavelength ranges appropriate to optimum colour reproduction.

Similarly it is not necessary that the light which reaches a donor layer be such as to give a sharp image in that layer as it would in a conventional system. Optimum image quality is generally achieved when all image-forming layers are located in positions relative to one another which are appropriate to optimum image quality of the product. Since the donor layers used in the material of use in this invention do not themselves form a final dye image no such constraint on their position in the assembly exists. Indeed it is often advantageous that they be placed in such a position that the light reaching them is considerably diffused with consequent maximum enhancement of image quality in the accepting layer in manner analogous to the effect of an unsharp mask.

In the photographic material of use in the present invention there is as hereinbefore stated at least one donor layer or there may be more than one donor layer. The position of the donor layer in colour photographic material may be varied depending on the result which it is required to produce. Often the spectral sensitivity of the donor layer is different from that of the acceptor layer with which it is associated.

Thus in one embodiment of the photographic material of the present invention there is provided colour photographic material which comprises at least one blue-light sensitive negative working silver halide emulsion layer containing a yellow dye-forming colour coupler, a filter layer, at least one green-light sensitive negative working silver halide emulsion layer containing a magenta dye-forming colour coupler and at least one red-light sensitive negative working silver halide emulsion layer containing a cyan dye-forming colour coupler and a support base, there being associated with at least one said green-light sensitive layer a donor layer which is sensitive to red-light. Preferably if there is only one green-light sensitive layer the donor layer is placed above this layer and below the filter layer which can be so constructed to prevent DI compounds diffusing into the blue sensitive layer which is above the filter layer. Alternatively if there are two green-sensitive layers the donor layer may be placed therebetween.

Similarly in another embodiment of this aspect of the invention there is present in the colour photographic material as just described a green sensitive donor layer which is associated with a red sensitive acceptor layer or layers. Preferably the green sensitive donor layer is located between the base and the red sensitive cyan producing layer where there is one such red layer or between the two red sensitive cyan image producing layers if there are two such layers.

In another embodiment of the invention there is present in the colour photographic material a donor layer which is associated with both a green sensitive and a red sensitive layer, and which is sensitive in the blue/green region of the spectrum. This layer is placed between the green sensitive layer and the red sensitive layer.

In another embodiment of the invention the donor layer is present in a material having layers of uniform spectral sensitivity such as intended for the production of monochrome images (such as described in British Pat. No. 492,518) in order to improve the sharpness of the material or to modify the dependence of its contrast or wavelength.

However a very large number of possible positions for donor layers is possible in the photographic material of use in the present invention.

Suitable DIR compounds which react with the oxidation products of a photographic colour developer to yield a substantially colourless product are those described in British Pat. Nos. 1,224,555; 1,484,273; in U.S. Pat. No. 3,928,041 and in German Offenlegungsschrift No. 2,362,752.

Further suitable photographic development inhibitor compounds which couple with an oxidised colour developer to yield a colourless compound and to release a development inhibiting compound are those of the formula

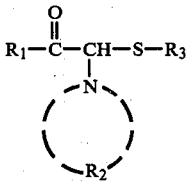

(1)

wherein $R_1$ is substituted phenyl which contains a ballasting alkyl group, $R_2$ represents the atoms necessary to complete a five or six membered heterocyclic ring system which may be further substituted and/or benzannelated and $R_3$ is an aryl, or heterocyclic radical, any of which ring systems may be further substituted, the group —S—$R_3$ being a development inhibiting group.

By ballasting alkyl group is meant a straight or branched chain alkyl group, optionally substituted, having at least 10 carbon atoms. (The alkyl group and its substituents contain at least 10 carbon atoms). The presence of the ballasting alkyl group in the DIR compound renders this compound substantive to the layer in which it is coated.

In the compounds of formula (1) both the group

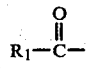

and the group

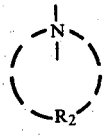

which are attached to the central methine group of the compound are electron withdrawing groups. This means that the methine group is an activated methine group which can couple with oxidised colour developers of the para-phenylene diamine type in the same way as colour couplers couple with such oxidised colour developers. The coupling of the compound of formula (1) with oxidised colour developer leads to an unstable compound in which elimination occurs and the group $R_3$—$S^{\ominus}$ is released. The compound HS—$R_3$ is a development inhibitor compound.

Suitable $R_3$—S— groups are members of the mercapto pyrimidine series, members of the mercapto thiadiazole series such as a 2-mercapto thiadiazolotriazine, members of the mercapto triazine series, members of the mercapto tetrazole series, or members of the mercapto triazole series, or an optionally substituted mercapto benzene, of which the substituents may be for example carboxyl, nitro or acylated amino groups, such as 1-mercapto-2-benzoic acid, 1-mercapto-2-nitrobenzene, or 1-mercapto-3-heptadecanoylamino benzene.

$R_3$ is thus optionally substituted pyrimidyl, thiadiazolyl, triazinyl, tetrazolyl, triazolyl, pyridyl (substituents $C_1$–$C_4$ alkyl and/or hydroxyl), phenyl (substituents carboxyl, nitro or acylated amino groups, wherein acyl contains 1 to 18 carbon atoms) or benzthiazolyl.

Preferably $R_3$ is a phenyl substituted tetrazole group.

Preferably $R_2$ represents the atoms necessary to complete an optionally substituted triazole, tetrazole, pyrazole, imidazole or benzimidazol ring system. Examples of substituents which may be present in the ring system are alkyl groups ($C_1$–$C_4$), alkylthio groups (R—S—, $C_1$–$C_8$) and phenyl or halogenphenyl (chlorophenyl) groups.

Particularly useful groups $R_1$ are those of the formula

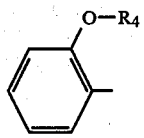

(2)

where $R_4$ is a ballasting alkyl group or contains a ballasting optionally substituted alkyl group of at least 10 carbon atoms.

Other useful groups $R_1$ are those of the formula

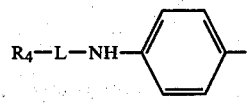

(3)

where L is an $—SO_2—$ or —CO-link and $R_4$ is as just defined.

Preferred are those DIR compounds of formula (1) wherein $R_1$ is a group of the formula

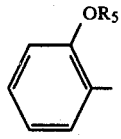
(4)

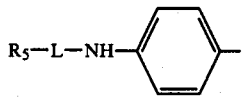
(5)

or

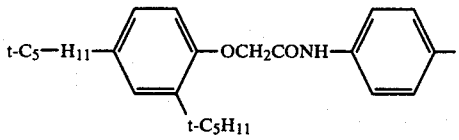
(6)

wherein L is $—SO_2—$ or —CO— and $R_5$ is alkyl of 10 to 18 carbon atoms, $R_2$ represents the atoms necessary to complete an optionally alkyl of 1 to 4 carbon atoms or alkylthio of 1 to 8 carbon atoms substituted tetrazole, triazole, pyrazole or imidazole or optionally nitro substituted benzimidazole ring system and $R_3$ is pyrimidyl, thiadiazolyl, triazinyl, tetrazolyl or triazolyl, pyridyl, optionally substituted by alkyl of 1 to 4 carbon atoms or hydroxyl or phenyl optionally substituted by carboxyl, nitro or acylamino wherein acyl contains 1 to 18 carbon atoms, or benzthiazolyl.

Compounds of formula (1) may be prepared by reacting a solution of a compound of the general formula

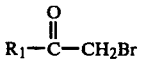
(7)

with a solution of a compound of formula

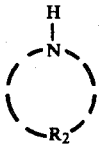
(8)

where $R_1$ and $R_2$ have the meanings assigned to them above in the presence of a base, reacting a solution of the resultant compound of the formula

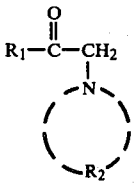
(9)

with halogen to form a compound of the formula

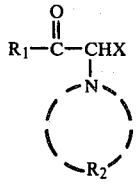
(10)

where X is halogen and reacting the solution of a compound of formula (10) with a compound of the formula M—S—$R_3$ where $R_3$ has the meaning assigned to it above and M is an alkali metal.

Suitable DIR compounds of the hydroquinone type are described in British Pat. Nos. 1,450,480 and 1,467,732.

The photographic material of the present invention may contain suitable additions of 2- and 4-equivalent colourless and/or coloured couplers, DIR colour-couplers, antifoggants, cross linking agents, spreading agents and other additives as used in photographic emulsion layers. 2- and 4-equivalent colour couplers are for example described in British Pat. Nos. 1,134,504, 1,128,037, 1,173,214, 1,173,513, 1,078,338, 1,420,637, 1,038,331, 1,084,480, 1,165,563 and 1,520,880.

Both the donor and acceptor layers are preferably a gelatino silver halide emulsion layer and most preferably an iodobromide layer. However they may contain as the binder for the silver halide any one or a mixture of a synthetic or naturally occurring hydrophilic colloid for example albumin, casein, polyvinyl alcohol or a cellulose ester or ether.

The emulsions used in preparing the photographic material of the invention can be chemically sensitised by well known procedures. The emulsions can be digested with natural active gelatin, or sulphur compounds can be added, such as those described in British Pat. Nos. 235,211 and 544,812 (U.S. Pat. No. 2,410,689). The emulsions can also be treated with salts of the noble metals such as ruthenium, rhodium, palladium, iridium and platinum. The emulsions can contain sensitising amounts of reducing agents such as stannous salts (British Pat. No. 658,592), or polyamines, such as diethylenetriamine.

The emulsions can contain speed-increasing compounds of the quaternary type as described in British Pat. Nos. 557,178, 558,710 and 560,082 and of the polyethylene glycol type as described in U.S. Pat. No. 2,866,437.

The photographic base may be any base normally used for photographic negative films, for example a cellulose triacetate, cellulose, acetate-butyrate or a polyester which has been treated to enable a hydrophilic coating to remain adherent thereto.

The reverse side of the base may have coated thereon an anti-halation assembly. Alternatively the material may have an anti-halation underlayer beneath the lowest coated sensitive emulsion layer.

The following Example will serve to illustrate the invention but in no way limits the scope of the invention.

EXAMPLE

A series of multilayer colour negative films were made having the following structure. The layers are numbered in order, layer 1 being nearest the film support. The various materials differ in the composition of the donor layer (layer 5), details of which are shown separately.

| | | |
|---|---|---|
| LAYER 1 | | |
| FIRST RED LAYER | 16.0 mg/dm$^2$ | slow AgBr/I emulsion containing 4 mole % iodide and 150 mg each of sensitising dyes 1 and 2 per mole of silver halide |
| | 11.0 mg/dm$^2$ | colourless cyan forming coupler 1 |
| | 0.4 mg/dm$^2$ | magenta coloured cyan forming coupler 2 |
| | 22.0 mg/dm$^2$ | gelatin |
| LAYER 2 | | |
| SECOND RED LAYER | 16.0 mg/dm$^2$ | fast AgBr/I emulsion containing 7½ mole % iodide and 100 mg each of sensitising dyes 1 and 2 per mole of silver halide |
| | 4.5 mg/dm$^2$ | colourless cyan forming coupler 1 |
| | 0.4 mg/dm$^2$ | magenta coloured cyan forming coupler 2 |
| | 1.0 mg/dm$^2$ | colourless cyan forming DIR coupler 3 |
| | 16.0 mg/dm$^2$ | gelatin |
| LAYER 3 | | |
| INTERLAYER | 1.0 mg/dm$^2$ | ditertiary-octyl hydroquinone |
| | 15.0 mg/dm$^2$ | gelatin |
| LAYER 4 | | |
| FIRST GREEN LAYER | 16.0 mg/dm$^2$ | slow AgBr/I emulsion containing 4 mole % iodide and 180, 90 and 30 mg respectively of sensitising dyes 3, 4 and 5 per mole of silver halide |
| | 5.0 mg/dm$^2$ | colourless magenta forming coupler 4 |
| | 0.5 mg/dm$^2$ | yellow coloured magenta forming coupler 5 |
| | 17.0 mg/dm$^2$ | gelatin |
| LAYER 5 | | |
| "DONOR LAYER" | | |
| LAYER 6 | | |
| INTERLAYER | 1.0 mg/dm$^2$ | ditertiary octyl hydroquinone |
| | 10.0 mg/dm$^2$ | gelatin |
| LAYER 7 | | |
| SECOND GREEN LAYER | 16.0 mg/dm$^2$ | fast AgBr/I emulsion containing 7.5 mole % iodide and 120, 60 and 20 mg respectively of sensitising dyes 3, 4 and 5 per mole of silver halide |
| | 1.5 mg/dm$^2$ | colourless magenta forming coupler 4 |
| | 1.5 mg/dm$^2$ | yellow coloured magenta forming coupler 5 |
| | 15.0 mg/dm$^2$ | gelatin |
| LAYER 8 | | |
| INTERLAYER | 1.0 mg/dm$^2$ | ditertiary octyl hydroquinone |
| | 10.0 mg/dm$^2$ | gelatin |
| LAYER 9 | | |
| YELLOW COLLOIDAL SILVER FILTER LAYER | 10.0 mg/dm$^2$ | gelatin |
| LAYER 10 | | |
| FIRST BLUE LAYER | 9.0 mg/dm$^2$ | slow AgBr/I emulsion containing 4 mole % iodide |

-continued

| | | |
|---|---|---|
| | 7.7 mg/dm$^2$ | colourless yellow forming coupler 6 |
| | 13.0 mg/dm$^2$ | gelatin |
| LAYER 11 | | |
| SECOND BLUE LAYER | 6.0 mg/dm$^2$ | fast AgBr/I emulsion containing 7½ mole % iodide |
| | 4.3 mg/dm$^2$ | colourless yellow forming coupler 6 |
| | 9.0 gm/dm$^2$ | gelatin |
| LAYER 12 | | |
| PROTECTIVE GELATIN OVERCOAT | 15.0 mg/dm$^2$ | gelatin. |

COUPLERS (1.) 1-Hydroxy-2-[δ-(2,4-ditertiary-amyl-phenoxy)-n-butyl] naphthamide (2) 2-{5-[(2,4-bis (1,1-dimethylpropyl-phenoxy)acetamide]--2-chlorophenylcarbamoyl}-4-[4-(N-methylbenzamido)-phenylazo]-1-naphthol (3) 1-Hydroxy-4-(1-phenyl-5-tetrazolylthio)-2-[δ-(2,4-ditertiary amyl phenoxy)-n-butyl]naphthamide (4) 1-(2,4,6-trichlorophenyl)-3-[3-α-(2,4-ditertiaryamyl phenoxy)acetamido-benzamido]-5-pyrazolone (5) 1-(2,4,6-trichlorophenyl)-3-[3-α-(2,4-ditertiaryamyl phenoxy)acetamide-benzamido]-4-(p-methoxyphenyl azo)-5-pyrazolone (6) α-(p-methoxybenzoyl-4-carboxy-3-(N-methyl-n-octadecyl) amino acetanilide DIR-couplers of the formulae (7)

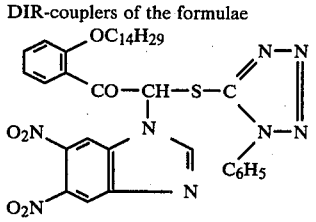

(8)

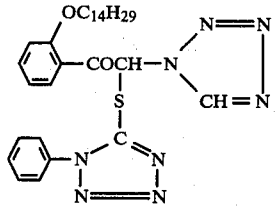

(9)

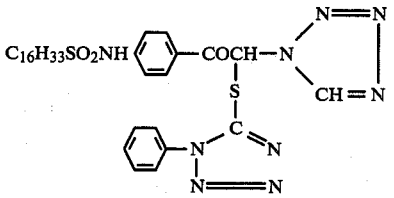

(10)

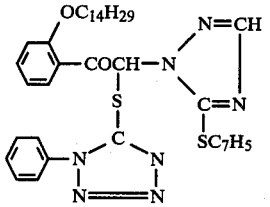

(11)

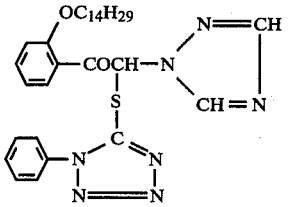

-continued (12)

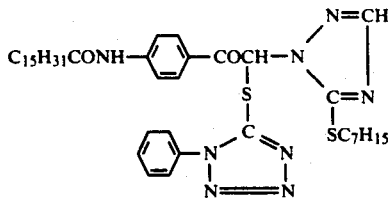

Sensitising Dyes (1)

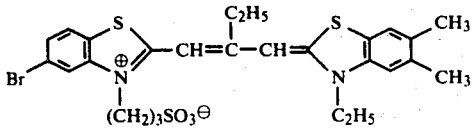

(2)

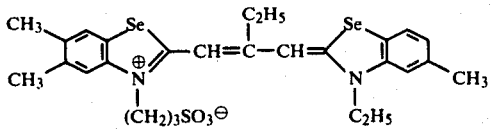

(3)

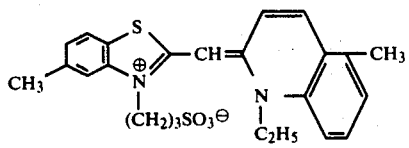

(4)

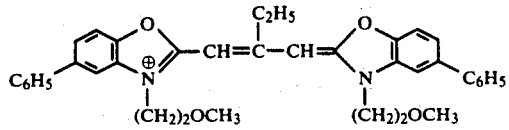

(5)

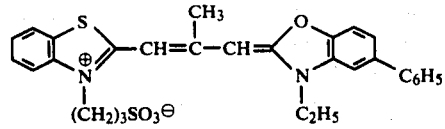

(6)

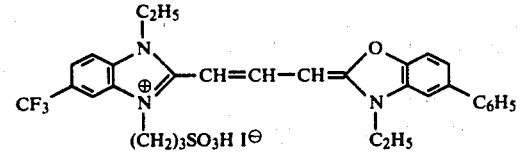

COMPOSITION OF DONOR LAYERS (LAYER 5)

SAMPLE 1 Dummy layer containing 8.0 mg/dm$^2$ gelatin only

SAMPLE 2 3.0 mg/dm$^2$ medium speed AgBr/I emulsion containing 7½ mole % iodide and 125 mg each of sensitising dyes (1) and (2) per mole of silver halide
4.0 mg/dm$^2$ colourless DIR coupler(7)
8.0 mg/dm$^2$ gelatin SAMPLE 3 As 2 but emulsion contains 250 mg of sensitising dye (2) alone per mole silver halide SAMPLE 4 As 2 but emulsion contains 150, 75 and 25 mg respectively of sensitising dyes (3) (4)and(5) per mole silver halide SAMPLE 5 As 2 but emulsion contains 250 mg of sensitising dye (6) alone per mole silver halide SAMPLE 6 As 2 but emulsion contains 50 and 200 mg of sensitising dyes (2) and (6) respectively.

The examples in this series represent the interposition of a donor layer in a colour negative tripack in such a way that it interacts only with the green layer. Sample 1 contains a dummy gelatin layer in the donor position and acts as a standard.

The donor layer in the second sample has similar spectral sensitising to that of the red layer. Increases in sharpness were found when the material was exposed using a Sayce chart, as shown in table 1:

TABLE 1

| | RESPONSE OF GREEN LAYER (%) | | | | | |
|---|---|---|---|---|---|---|
| Spatial Frequency (lines/mm) | 3 | 6 | 10 | 20 | 30 | 50 |
| SAMPLE 1 (Standard) | 84 | 72 | 64 | 37 | 22 | 11 |
| SAMPLE 2 | 86 | 77 | 72 | 48 | 29 | 19 |

The effect of the donor layer on colour reproduction was to increase the saturation of greens and magentas, and to give an advantageous line shift to purple-reds and bluish-greens. This effect was increased (Sample 3) by a change to a sensitising dye having a peak sensitivity at 670 nm.

In sample 4 the donor layer has conventional green sensitivity. This has the effect of improving sharpness without change of colour reproduction. However it was found to be preferable to use a green sensitising dye which gave peak sensitivity at 520 nm (sample 5). This results in improved reproduction of blues and yellow-greens.

The best overall spectral sensitivity for this particular system was found to be that shown by sample 6 which has a donor layer having two maxima of sensitivity, one at 670 nm and one at 520 nm.

The same good results can be obtained when using the DIR-couplers (8) to (12) instead of DIR-coupler (7).

TABLE 2

| | MUNSELL HUE/CHROMA OF REPRODUCTION | | | | | |
|---|---|---|---|---|---|---|
| Samples | 1 (STANDARD) | 2 | 3 | 4 | 5 | 6 |
| λMAX (nm) | — | 640 | 670 | 550 | 520 | 520/670 |
| 7RP/5.0[1] | 6R/9.5 | 2R/11.0 | 1R/11.1 | 6R/9.5 | 6R/9.5 | 4R/10.2 |
| 5R/13.0 | 10R/13.0 | 7R/13.2 | 7R/13.2 | 10R/13.0 | 10R/13.0 | 8R/13.0 |
| 5G/7.2 | 8BG/7.1 | 5BG/8.1 | 5BG/8.2 | 8BG/7.0 | 8BG/6.8 | 8BG/6.7 |
| 3GY/6.6. | 5Y/7.5 | 6Y/6.5 | 6Y/6.5 | 5Y/7.5 | 7Y/7.5 | 7Y/7.5 |
| 8GY/9.8 | 5GY/6.6. | 6GY/7.2 | 6GY/7.2 | 5GY/6.6 | 6GY/6.8 | 6GY/6.8 |
| 10PB/5.4 | 5P/4.4 | 6P/5.4 | 7P/6.6 | 5P/4.4 | 7P/5.3 | 7P/5.7 |
| 4PB/10.4 | 1PB/8.1 | 3B/8.2 | 2B/8.3 | 2PB/8.0 | 3PB/8.1 | 3PB/8.2 |
| 9R/4.2 | 10R/6.0 | 6R/7.2 | 6R/7.4 | 10R/6.0 | 10R/6.0 | 8R/6.4 |
| 6GY/4.2 | 6GY/4.2 | 7GY/4.9 | 8GY/5.5 | 6GY/4.2 | 7GY/4.7 | 7GY/4.7 |
| 9B/5.0 | 9BG/3.8 | 8BG/4.4 | 8BG/4.6 | 9BG/3.8 | 9BG/3.8 | 9BG/3.8 |

[1]This column relates to the peak wavelength of sensitivity
R = red, Y = yellow, G = green, B = blue, P = purple
(cf. Principles of color photography, by R. M. Evans, W.T. Hanson and W.L. Brewer, page 76, John Wiley and Sons, Inc., New York and Chapman and Hall, Ltd., London, 1953)

I claim:

1. A process for the production of a photographic image which comprises imagewise exposing photographic material which comprises on a support base at least one light-sensitive negative working silver halide emulsion layer containing a colour coupler and in which after colour processing a negative dye image only is formed, there being associated therewith at least one light-sensitive negative-working silver halide emulsion containing at least one DIR compound and in which after processing no photographic image is present, developing the photographic material in a colour developing solution to form a negative silver image in the layer which comprises the DIR compound and a coupled compound with the DIR compound in the areas in which the silver has been developed, so releasing the DI compound imagewise from the DIR compound and allowing the DI compound to diffuse imagewise into the layer containing the colour coupler thereby to modify colour development in this layer by forming a modified negative silver image and hence a modified negative dye image in the layer which comprises the colour coupler, and further processing the material so that no photographic image is present in the layer which comprises the DIR compound and no silver image is present in the layer which comprises the colour coupler and the dye image.

2. A process according to claim 1 wherein the DIR compound is a coupler which couples with the oxidation products of the colour developer both to release a DI compound and to yield a substantially colourless reaction product.

3. A process according to claim 1 wherein the DIR compound is a coupler which couples with the oxidation products of the colour developer both to release a DI compound and to yield a dye image which is either washed out of the layer or is destroyed in the layer during a subsequent processing step.

4. A process according to claim 1 wherein the DIR compound is a coupler which couples with the oxidation products of the colour developer both to release a DI compound and to yield a dye image, the effect of the image being counteracted by the presence of a colour coupler which becomes colourless on coupling.

5. A process according to claim 1 wherein the DIR coumpound is a hydroquinone derivative which reacts with the oxidation products of the colour developer both to release a DI compound and to yield a colourless reaction product.

6. A process according to claim 1 wherein the DIR-compound is a DIR-coupler of the formula

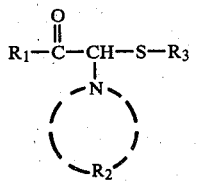

wherein $R_1$ is substituted phenyl which contains a ballasting alkyl group, $R_2$ represents the atoms necessary to complete a five or six membered heterocyclic ring system which may be further substituted or benzannelated and $R_3$ is an aryl or heterocyclic radical, any of which ring systems may be further substituted, the group —S—$R_3$ being a development inhibiting group.

7. Photographic material which comprises on a support base at least one light-sensitive negative working silver halide emulsion layer containing a colour coupler and in which after processing a photographic dye image only is formed, there being associated therewith at least one light-sensitive negative working silver halide emulsion layer in which after processing no photographic dye image is formed and which comprises at least one DIR compound which after reaction with the oxidation products of a colour developer releases a DI compound and forms a substantially colourless product.

8. Photograhic material according to claim 7 wherein the DIR compound is a DIR coupler.

9. Photographic material according to claim 7 wherein the DIR compound is a coupler with couples with the oxidation products of the colour developer both to release a DI compound and to yield a substantially colourless reaction product.

10. Photographic material according to claim 7 wherein the DIR compound is a coupler which couples with the oxidation products of the colour developer both to release a DI compound and to yield a dye image which is either washed out of the layer or is destroyed in the layer during a subsequent processing step.

11. Photographic material according to claim 7 wherein the DIR compound is a coupler which couples with the oxidation products of the colour developer both to release a DI compound and to yield a dye image, the effect of the image being counteracted by the presence of a colour coupler which becomes colourless on coupling.

12. Photographic material according to claim 7 wherein the DIR compound is a hydroquinone derivative which reacts will the oxidation products of the colour developer both to release a DI compound and to yield a colourless reaction product.

13. Colour photographic material according to claim 7 which comprises at least one blue-light sensitive negative working silver halide emulsion layer containing a yellow dye-forming coulour coupler, a filter layer, at least one green-light sensitive negative working silver halide emulsion layer containing a magenta dye-forming colour coupler and at least one red-light sensitive negative working silver halide emulsion layer containing a cyan dye-forming colour coupler and a support base, there being associated with at least one said green-light sensitive layer a light sensitive silver halide emulsion layer which is sensitive to red light in which after processing no photographic dye image is formed and which comprises a least one DIR compound which after reaction with the oxidation products of a colour developer releases a DI compound and forms a substantially colourless product.

14. Colour photographic material according to claim 13 wherein there is only one green-light sensitive layer and the light sensitive emulsion layer which is sensitive to red light and which contains the DIR compound is present between the filter layer and the green-light sensitive layer.

15. Colour photographic material according to claim 13 wherein there are two green-light sensitive layers and the light sensitive emulsion layer which is sensitive to red light and which contains the DIR compound is present therebetween.

16. Colour photographic material according to claim 7 which comprises at least one blue-light sensitive negative working silver halide emulsion layer containing a yellow dye-forming colour coupler, a filter layer, at least one green-light sensitive negative working silver halide emulsion layer containing a magenta dye-forming colour coupler and at least one red-light sensitive negative working silver halide emulsion layer containing a cyan dye-forming colour coupler and a support base, there being associated with at least one said red-light sensitive layer a light sensitive silver halide emulsion layer which is green-light sensitive in which after processing no photographic dye image is formed and which comprises at least one DIR compound which after reaction with the oxidation products of a colour developer releases a DI compound and forms a substantially colourless product.

17. Colour photographic material according to claim 16 wherein there is only one red-light sensitive layer and the light sensitive silver halide emulsion layer which is green-light sensitive and which contains a DIR compound is present between the red-light sensitive layer and the support base.

18. Colour photographic material according to claim 16 wherein there are two red-light sensitive layers and the light sensitive silver halide emulsion layer which is green-light sensitive and which contains a DIR compound is present therebetween.

19. Colour photographic material according to claim 7 which comprises at least one blue-light sensitive negative working silver halide emulsion layer containing a yellow dye-forming colour coupler, a filter layer, at least one green-light sensitive negative working silver halide emulsion layer containing a magenta dye-forming colour coupler, at least one red-light sensitive negative working silver halide emulsion layer containing a cyan dye forming colour coupler and a support base, there being placed between the green-light sensitive layer and the red light sensitive layer a light sensitive halide emulsion layer which is blue/green light sensitive, in which after processing no photographic dye image is formed and which comprises at least one DIR compound which after reaction with the oxidation products of a colour developer releases a DI compound and forms a substantially colourless product.

20. Colour photographic material according to claim 8, wherein the DIR-coupler is a compound of the formula

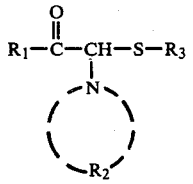

wherein $R_1$ is substituted phenyl which contains a ballasting alkyl group, $R_2$ represents the atoms necessary to complete a five or six membered heterocyclic ring system which may be further substituted or benzannelated and $R_3$ is an aryl or heterocyclic radical, any of which ring systems may be further substituted, the group —S—$R_3$ being a development inhibiting group.

21. Colour photographic material according to claim 20, wherein $R_1$ is a group of the formulae

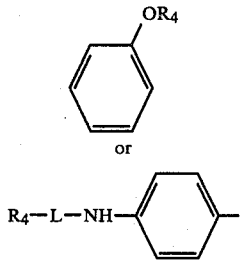

wherein L is —$SO_2$— or —CO— and $R_4$ is a ballasting alkyl group or contains an optionally substituted ballasting alkyl group of at least 10 carbon atoms, $R_2$ represents the atoms necessary to complete a tetrazole, triazole, pyrazole, imidazole or benzimidazol ring system optionally substituted by alkyl or alkylthio and $R_3$ is optionally substituted pyrimidyl, thiadiazolyl, triazinyl, tetrazolyl, triazolyl, pyridyl, phenyl or benzthiazolyl.

22. Colour photographic material according to claim 21, wherein $R_3$ is pyrimidyl, thiadiazolyl, triazinyl, triazolyl, tetrazolyl or an optionally substituted phenyl.

23. Colour photographic material according to claim 21 wherin $R_1$ is a group of the formulae

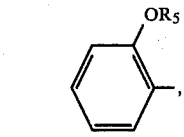

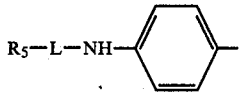

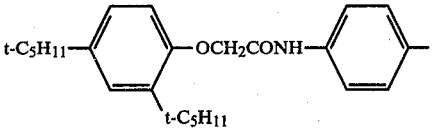

wherein L is —$SO_2$— or —CO— and $R_5$ is alkyl of 10 to 18 carbon atoms, $R_2$ represents the atoms necessary to complete an optionally alkyl of 1 to 4 carbon atoms or alkylthio of 1 to 8 carbon atoms substituted tetrazole, triazole, pyrazole or imidazole or optionally nitro substituted benzimidazole ring system and $R_3$ is pyrimidyl, thiadiazolyl, triazinyl, tetrazolyl or triazolyl, pyridyl optionally substituted by alkyl of 1 to 4 carbon atoms or hydroxyl or phenyl optionally substituted by carboxyl, nitro or acylamino, wherein acyl contains 1 to 18 carbon atoms, or benzthiazolyl.

* * * * *